US012404055B2

(12) United States Patent
Monti

(10) Patent No.: US 12,404,055 B2
(45) Date of Patent: Sep. 2, 2025

(54) METHOD FOR FILLING BOTTLES WITH A PREDETERMINED NUMBER OF PHARMACEUTICAL ARTICLES AND AN APPARATUS FOR ACTUATING THE METHOD

(71) Applicant: Marchesini Group S.P.A., Pianoro (IT)

(72) Inventor: Giuseppe Monti, Pianoro (IT)

(73) Assignee: Marchesini Group S.P.A. (IT)

( * ) Notice: Subject to any disclaimer, the term of this patent is extended or adjusted under 35 U.S.C. 154(b) by 81 days.

(21) Appl. No.: 18/557,136

(22) PCT Filed: May 4, 2022

(86) PCT No.: PCT/IB2022/054098
§ 371 (c)(1),
(2) Date: Oct. 25, 2023

(87) PCT Pub. No.: WO2022/238814
PCT Pub. Date: Nov. 17, 2022

(65) Prior Publication Data

US 2024/0217685 A1 Jul. 4, 2024

(30) Foreign Application Priority Data

May 10, 2021 (IT) ..... 102021000011864

(51) Int. Cl.
*B65B 5/10* (2006.01)
*B65B 57/20* (2006.01)

(52) U.S. Cl.
CPC ..... *B65B 5/103* (2013.01); *B65B 57/20* (2013.01)

(58) Field of Classification Search
CPC ..... B65B 5/103; B65B 57/20
See application file for complete search history.

(56) References Cited

U.S. PATENT DOCUMENTS 3,081,588 A * 3/1963 Klapes ..... B65B 5/103 53/55
4,501,339 A * 2/1985 Fukuda ..... G01G 13/00 177/25.14

(Continued)

FOREIGN PATENT DOCUMENTS

CN 114852390 A * 8/2022
DE 102014210234 A1 12/2014

(Continued)

OTHER PUBLICATIONS

International Search Report, Jun. 28, 2022.
Written Opinion of the International Searching Authority, Jun. 28, 2022.

*Primary Examiner* — Lucas E. A. Palmer
(74) *Attorney, Agent, or Firm* — Endurance Law Group PLC

(57) ABSTRACT

A method and apparatus for filling bottles with a predetermined number of pharmaceutical articles comprises positioning a separating wall with respect to descent channels so that a first accumulation chamber and a second accumulation chamber can respectively receive pharmaceutical articles from a different number of descent channels. The two accumulation chambers will accumulate pharmaceutical articles at differing rates. When one accumulation chamber has accumulated the predetermined number of pharmaceutical articles, the method comprises: unloading the pharmaceutical articles into the first bottle, positioning a second bottle paused beneath the unloading conduit, and then, as soon as the predetermined number of pharmaceutical articles has been accumulated in the other accumulation chamber, unloading the pharmaceutical articles of the other accumulation chamber into the second bottle.

10 Claims, 4 Drawing Sheets

(56) References Cited

U.S. PATENT DOCUMENTS 5,348,061 A * 9/1994 Riley ..... B65B 5/103 221/133
5,838,575 A * 11/1998 Lion ..... G07F 11/62 221/9
6,899,148 B1 * 5/2005 Geltser ..... A61J 7/02 141/105
7,956,623 B2 * 6/2011 Bassani ..... B65B 57/14 324/672
8,225,925 B2 * 7/2012 Bassani ..... B65B 57/20 198/758
8,386,073 B2 * 2/2013 Kim ..... B65B 39/003 700/242
8,985,389 B2 * 3/2015 Yuyama ..... A61J 7/02 221/224
9,037,291 B2 * 5/2015 Terzini ..... A61J 7/02 700/242
11,155,378 B2 * 10/2021 Savoie-Lavigueur .... B65B 1/06
11,217,336 B2 * 1/2022 Anthony ..... G16H 20/13
11,348,398 B1 * 5/2022 Di Genova ..... A61J 7/02
2009/0090659 A1 * 4/2009 Monti ..... B65B 57/14 209/587
2009/0199512 A1 * 8/2009 Sala ..... B65B 5/101 53/448
2009/0255948 A1 * 10/2009 Bassani ..... B65B 57/10 221/311
2013/0042943 A1 * 2/2013 Bassani ..... B65B 57/20 700/242
2013/0269831 A1 * 10/2013 Monti ..... B65B 5/103 141/94
2020/0375848 A1 * 12/2020 Gamberini ..... A61J 3/074
2022/0267036 A1 * 8/2022 Shah ..... G01N 21/9508
2024/0201135 A1 * 6/2024 Kronawitter ..... B65B 7/28

FOREIGN PATENT DOCUMENTS

KR 20140124501 A 10/2014
WO 2014087372 A1 6/2014
WO 2020178706 A1 9/2020

* cited by examiner

METHOD FOR FILLING BOTTLES WITH A PREDETERMINED NUMBER OF PHARMACEUTICAL ARTICLES AND AN APPARATUS FOR ACTUATING THE METHOD

FIELD OF THE INVENTION

The present invention relates to the technical sector relating to the packing of bottles with pharmaceutical or para-pharmaceutical articles, in particular to the inserting of a predetermined number of pharmaceutical articles, such as for example tablets, internally of respective bottles.

In particular, the present invention concerns a method for filling bottles with a predetermined number of pharmaceutical articles and to a relative apparatus designed to carry out the count of pharmaceutical articles and the subsequent unloading thereof internally of relative bottles for carrying out the method.

DESCRIPTION OF THE PRIOR ART

For the packaging of pharmaceutical articles internally of bottles, a need is known for carrying out the filling of the bottles with a predetermined number of pharmaceutical articles, for placing on the market.

It is therefore necessary to proceed to a count of the articles and to a prior accumulation thereof up to reaching the predetermined number for filling the bottle, before unloading them internally of the bottle.

In this regard, apparatuses are known, which in the sector are known as counters, for carrying out the count of the pharmaceutical articles that are to be inserted in a given number into a bottle, and then for unloading the articles into the bottle. Pharmaceutical articles are usually accumulated inside a storage hopper while the bottles to be filled are advanced one following another along a conveying line, for example constituted by a screw conveyor.

To transport the pharmaceutical articles from the storage hopper to a filling area above the bottles advancing along the conveying line, a vibrating conveyor is used, which is provided with a series of transport channels having a "V" shape, into which the pharmaceutical articles exiting from the storage hopper are deposited.

The vibrating conveyor, with its vibrating motion, advances the pharmaceutical articles, deposited into the various transport channels, distancing them one from the others.

A known apparatus for carrying out the count of the pharmaceutical articles coming from the vibrating conveyor, and for the subsequent insertion thereof into bottles advancing along the conveying line, is for example illustrated in FIG. 1A.

The known apparatus (A1) comprises a plurality of descent channels (D1), each having an entry opening (a) and an exit opening (b).

The descent channels (D1) are arranged in such a way that the entry openings (a) are located immediately downstream of ends of the transport channels of the vibrating conveyor (V) so that the pharmaceutical articles, having passed beyond the end of the transport channels, can fall by force of gravity into the entry openings (a) of the descent channels (D1), and thus fall into the descent channels (D1) and be conveyed towards the exit opening (b).

The apparatus (A1) comprises sensor means (S1), which are arranged so as to perform a count of the pharmaceutical articles that fall internally of each descent channel (D1), and which are configured in such a way as to provide the apparatus (A1) with a datum relative to the overall number of pharmaceutical articles present internally of the descent channels (D1).

The apparatus (A1) further comprises an accumulation chamber (C1), generally having a funnel shape, arranged below the descent channels (D1), which is predisposed to receive and accumulate the pharmaceutical articles exiting from the exit openings (b) of the descent channels (D1), up to the number necessary for the following insertion thereof into a relative bottle (F).

This accumulation chamber (C1) inferiorly comprises an unloading mouth (S1) for unloading the pharmaceutical articles accumulated internally thereof.

A hatch door (G1) is present and movable to open and close the unloading mouth (S1).

The apparatus (A1) is also equipped with closing elements (E) of the exit openings (b) of the descent channels (D1), which are activatable for closing the exit openings (b) once there is the necessary number of pharmaceutical articles in the accumulation chamber (C1) to fill a bottle (F).

The apparatus (A1) is arranged in such a way that the unloading mouth (S1) of the accumulation chamber is located above the conveying line (L) of the bottles (F).

A tubular unloading element (T1) is present below the unloading mouth (S1), which connects the unloading mouth (S1) with the mouth of a bottle (F) which connecting element is positioned by the conveying line (L) paused below the counter apparatus (A1), for unloading the pharmaceutical articles (F) into the bottle.

The hatch door (G1) at the discharge mouth (S1) is positioned in such a way as to keep the unloading mouth (S1) closed until there is the predetermined number of pharmaceutical articles in the accumulation chamber (C1), falling from the descent channels (D1), necessary to fill a bottle.

Then, as soon as the predetermined number of pharmaceutical articles necessary to fill the bottle (F) has fallen into the accumulation chamber (C1), the closing elements (E) of the descent channels (D1) are activated to close the exit openings (b) of the descent channels (D1), while the hatch door (G1) is moved to open the unloading mouth (S1) and allow the pharmaceutical articles to fall into the unloading conduit (T1) which conveys the pharmaceutical articles internally of the bottle (F).

Once all the pharmaceutical articles have been unloaded from the unloading mouth (S1), a hatch door (G1) can be returned into the closed position of the unloading mouth (S1) and the closing elements (E) moved to open the exit openings (b) of the descent channels (D1) by the fall of further pharmaceutical articles into the accumulation chamber (C1); in the meantime, the conveying line (L) will position a following bottle (F*) to be filled beneath the unloading conduit (T1).

With this type of apparatus, for increasing productivity, i.e. the number of bottles filled for a given time unit (for example per minute), one method is to intervene, by increasing the operating velocity of the vibrating conveyor, so as to be able to make a greater number of pharmaceutical articles fall into the descent channels. This has seen to be substantially effective in the event that the number of pharmaceutical articles to be inserted in a bottle is quite high.

On the other hand, the same results were not obtained when the number of pharmaceutical articles to be inserted in the bottles is quite low, such as for example less than 20-30.

In fact, in these cases, it is necessary to keep one or more of the descent channels closed, as otherwise a number of pharmaceutical articles would accumulate in the accumulation chamber that is greater than what is necessary during the pause time of the bottle beneath the counter apparatus.

Another known method at present used for the purposes of increasing the productivity consists in predisposing two or more counter apparatuses, both made as described in the foregoing, one by the side of another (as for example illustrated in FIG. 1B), so that, while a first apparatus (A1) carries out the filling of a first bottle (F1), a second apparatus (A2) can carry out the filling of a second bottle (F2).

This mode however, as is clear, brings with it the need to predispose an adequate space for the positioning of the various counter apparatuses one flanked to the others, and is therefore disadvantageous in terms of size and optimisation of work spaces.

Further, it can occur that one of the two apparatuses might accumulate, in the accumulation chamber thereof, the predetermined number of articles to be unloaded into one bottle before the other: in these cases, before activating the conveying line, it will be necessary in any case to wait for the other apparatus also to accumulate, in the accumulation chamber thereof, the predetermined number of pharmaceutical articles and to unload them into the respective bottle positioned below it.

SUMMARY OF THE INVENTION

The aim of the present invention is therefore to describe a method for filling bottles with a predetermined number of pharmaceutical articles, and an apparatus for actuating the method, able to obviate the drawbacks present in the prior-art apparatuses described in the foregoing.

In particular, an aim of the present invention is therefore to describe a method, and a relative apparatus which actuates the method, which enables reducing the time required for carrying out the filling of bottles with a predetermined number of pharmaceutical articles, thus guaranteeing high productivity.

The cited aims are obtained with a method for filling bottles with a predetermined number of pharmaceutical articles, and with a relative apparatus which actuates the method, according to the contents of the claims.

BRIEF DESCRIPTION OF THE DRAWINGS

The characteristics of a preferred, but not exclusive, embodiment of the apparatus which allows actuation of the method of the invention, as well as the steps of the method of the invention, will be described in the following with reference to the appended tables of drawings, in which.

DESCRIPTION OF THE PREFERRED EMBODIMENTS

Figure 1B:
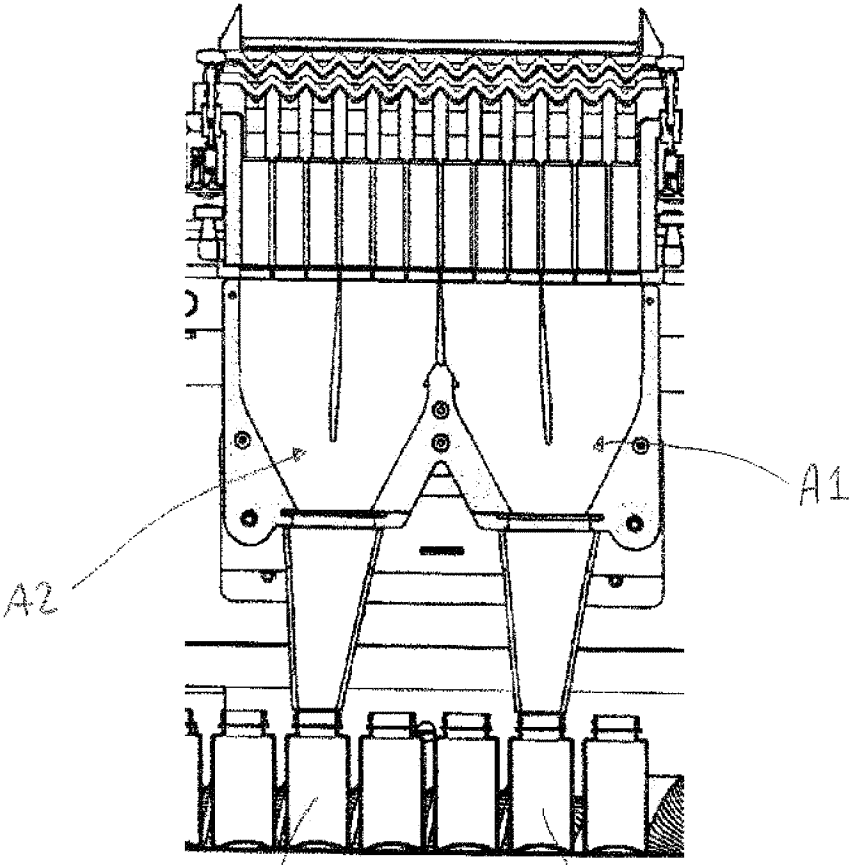
FIG.1B PRIOR ART
FIG. 1B, already mentioned in the foregoing, schematically illustrates, in a section view along a vertical section plane, a method used in the prior-art in order to increase productivity, in which two identical apparatuses like the one illustrated in FIG. 1A are arranged one flanked to the other, for the contemporaneous filling of two bottles.
Figure 1A:
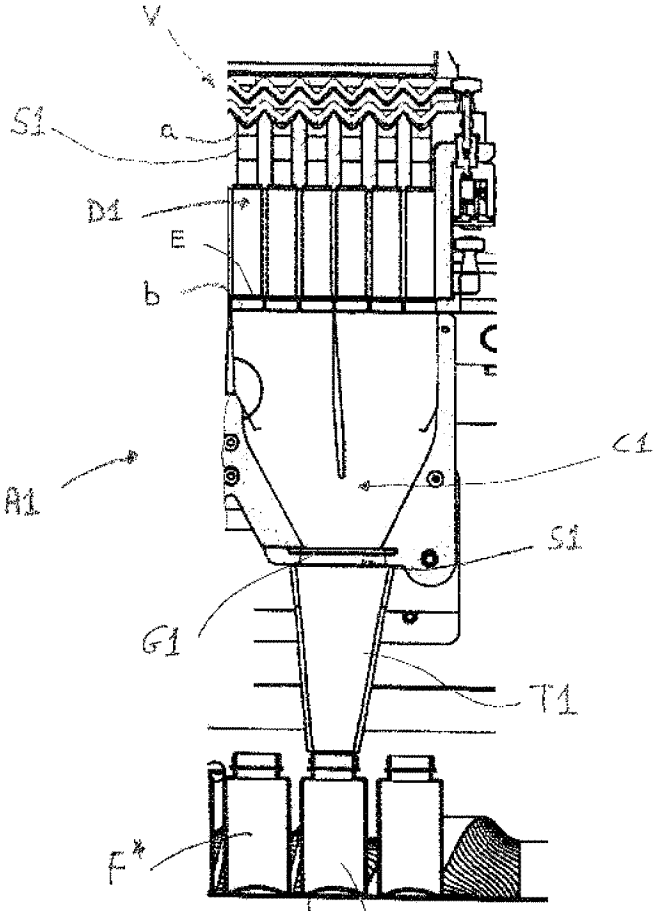
FIG. 1A, already mentioned in the foregoing, schematically illustrates, in a section view along a vertical section plane, an apparatus of known type used for filling bottles with a predetermined number of pharmaceutical articles.

With reference to the accompanying tables of drawings, reference numeral (100) denotes the apparatus which is used by the method of the invention for filling bottles with a predetermined number of pharmaceutical articles.

The apparatus (100) is configured to receive, count and unload pharmaceutical articles, such as for example tablets, and is arranged above the conveying line (L) of bottles (F) to be filled.

In particular, the apparatus (100) is configured to be positioned between a feeder of pharmaceutical articles, for example constituted by a vibrating conveyor (not illustrated in the appended figures as of known type and not pertinent to the invention) for the transport of rows of pharmaceutical articles and the conveying line ((L) of the bottles (F) which are to be filled with pharmaceutical articles.

The apparatus (100) comprises (see for example FIG. 2):

- a plurality of descent channels (1) of pharmaceutical articles which are configured to receive the pharmaceutical articles coming from the feeder of pharmaceutical articles (for example a vibrating conveyor) internally thereof, and to cause them to fall freely;
- an accumulation container (2), arranged below the descent channels (1) and having, superiorly, an entry mouth (20), for receiving the pharmaceutical articles falling from the descent channels (1) and, inferiorly, having an unloading conduit (3), for unloading pharmaceutical articles internally of a bottle (F) positioned in a conveying line (L) beneath the unloading conduit (3).

The accumulation container (2) is conformed in such a way as to comprise:

- a first accumulation chamber (21) and a second accumulation chamber (22) which are adjacent to one another;
- a first unloading mouth (21B), inferiorly of the first accumulation chamber (21), and which is communicating with the unloading conduit (3);
- a second unloading mouth (22B), inferiorly of the second accumulation chamber (22), and which is communicating with the unloading conduit (3);
- a first closing element (21C), activatable to open/close the first unloading mouth (21B);
- a second closing element (22C), activatable to open/close the second unloading mouth (22B).

The accumulation container (2) further comprises a separating wall (4), arranged so as to mutually separate the first accumulation chamber (21) and the second accumulation chamber (22) in a zone at the entry mouth (20) of the accumulation container (2) and beneath the descent channels (1).

In this way, the separating wall (4) divides the entry mouth (20) into a first entry section (21A), for the first accumulation chamber (21), and into a second entry section (22A), for the second accumulation chamber (22).

Consequently, the first entry section (21A) can receive pharmaceutical articles from a first group of the descent channels (1) and the first accumulation chamber (21) can accumulate a predetermined number of pharmaceutical articles to be inserted into a first bottle (F1), and the second entry section (22A) can receive pharmaceutical articles from a second group of the descent channels (1) and the second accumulation chamber (22) can store a predetermined number of pharmaceutical articles to be inserted in second bottle (F2).

The separating wall (4) is arranged in such a way as to be movable and positionable with respect to the descent channels (1) equally: in a first position (P1), in which the separating wall (4) is positioned so that the first entry section (21A) and the second entry section (22A) can receive pharmaceutical articles from an equal number of descent channels (1), and at least in a second position (P2, P3), in which the separating wall (4) is positioned so that the first entry section (21A) and the second entry section (22A) can receive pharmaceutical articles from a different number of descent channels (1) with respect to one another.

For example, in the preferred embodiment illustrated in the figures of the drawings, the apparatus (100) is made in such a way as to comprise 12 descent channels (1).

Figure 2:
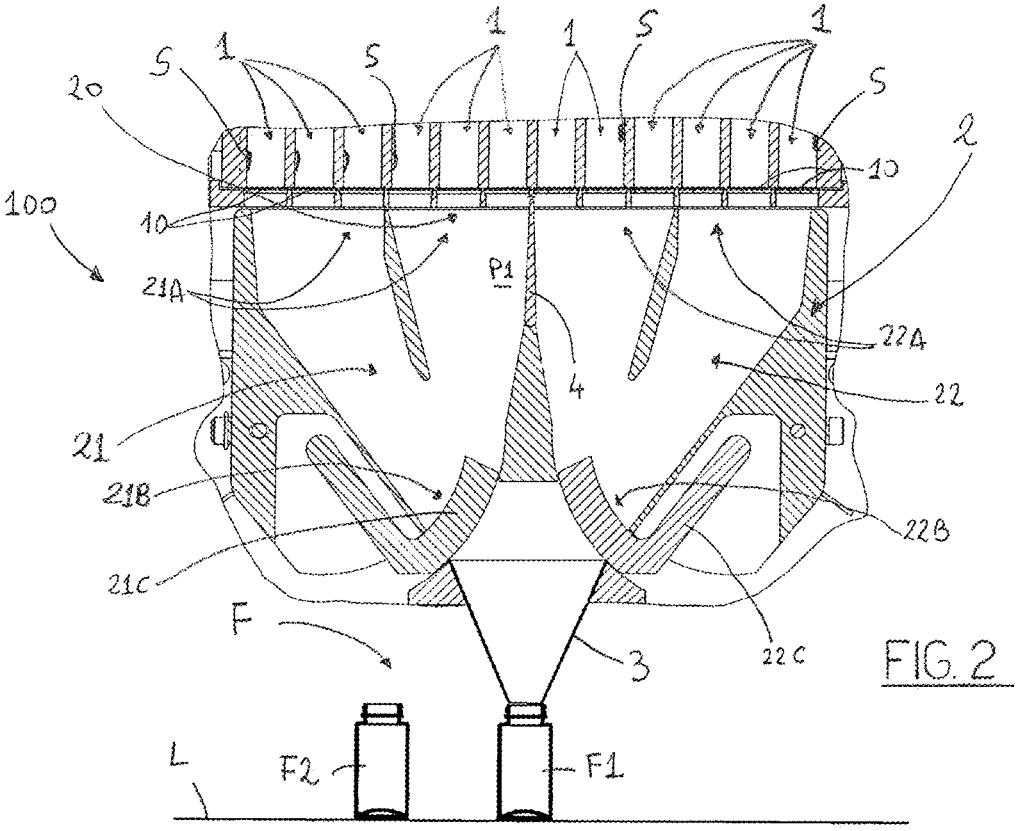
FIG. 2 is a schematic view in vertical section, illustrating the apparatus for carrying out the method of the invention.

The separating wall (4) can therefore be positioned in a first position (P1) in which it is positioned between the 6th and 7th descent channel (1), as shown in FIG. 2, so that the first entry section (21A) of the first accumulation chamber (21) can receive pharmaceutical articles from 6 descent channels (1) and also the second entry section (22A) of the second accumulation chamber (22) can receive pharmaceutical articles from 6 descent channels (1).

In this first position (P1) of the separating wall (4), the first accumulation chamber (21) and the second accumulation chamber (22) can thus receive pharmaceutical articles falling from a same number of the descent channels (1).

Figure 3A:
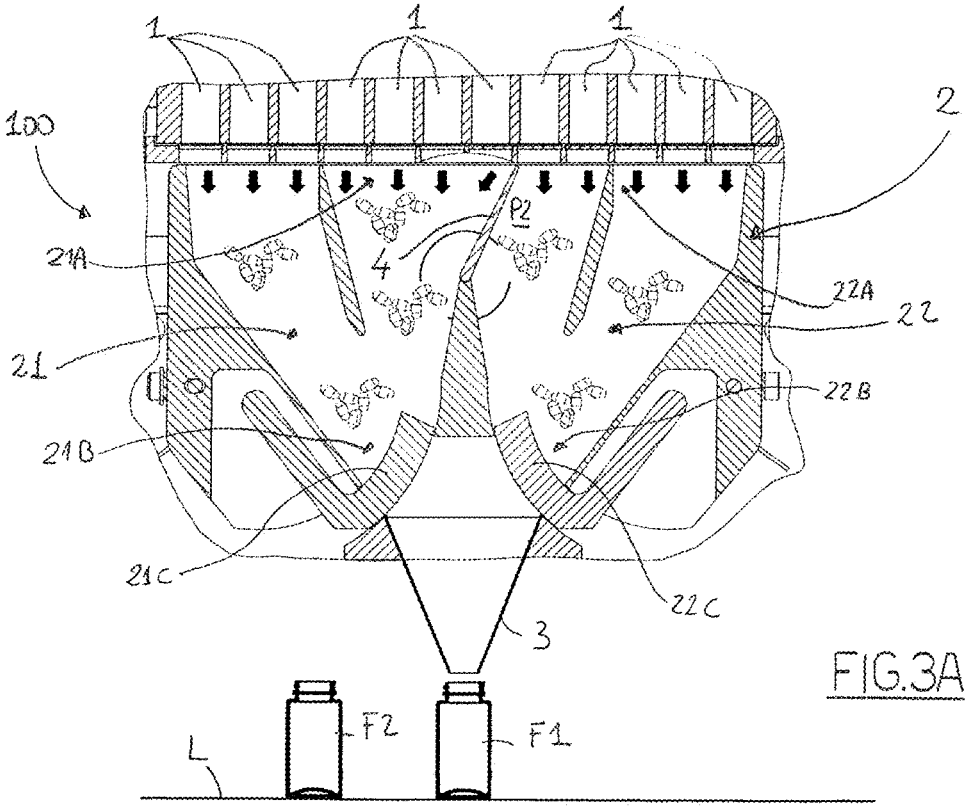
FIGS. 3A-3E illustrate, schematically and according to respective views in vertical section, an operating sequence of the method of the invention for filling bottles with a predetermined number of pharmaceutical articles.

The separating wall (4) can also be positionable in a second position (P2) in which it is positioned between the 7th and 8th descent channel, as shown for example in FIG. 3A, so that the first entry section (21A) of the first accumulation chamber (21) can receive pharmaceutical articles from 7 descent channels while the second entry section (22A) of the second accumulation chamber (22) can receive pharmaceutical articles from 5 descent channels (1).

In this second position (P2) of the separating wall (4), the first accumulation chamber (21) can thus receive pharmaceutical articles falling from a greater number of descent channels (1) with respect to the second accumulation chamber (22).

Figure 3B:
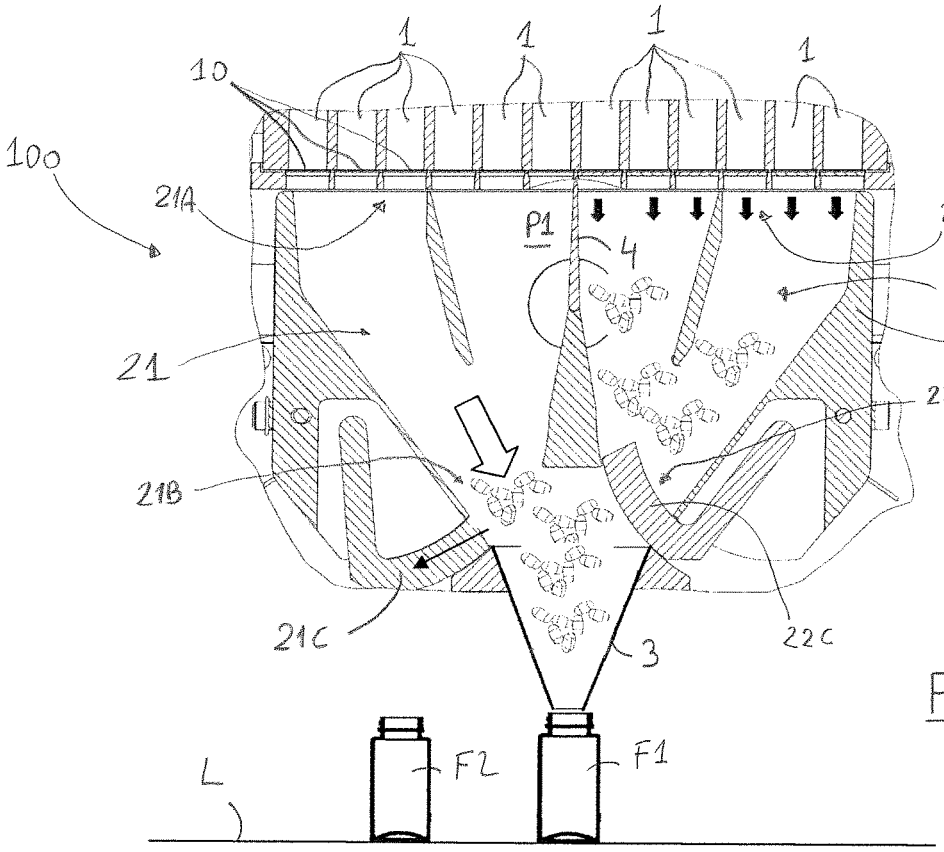
Figure 3C:
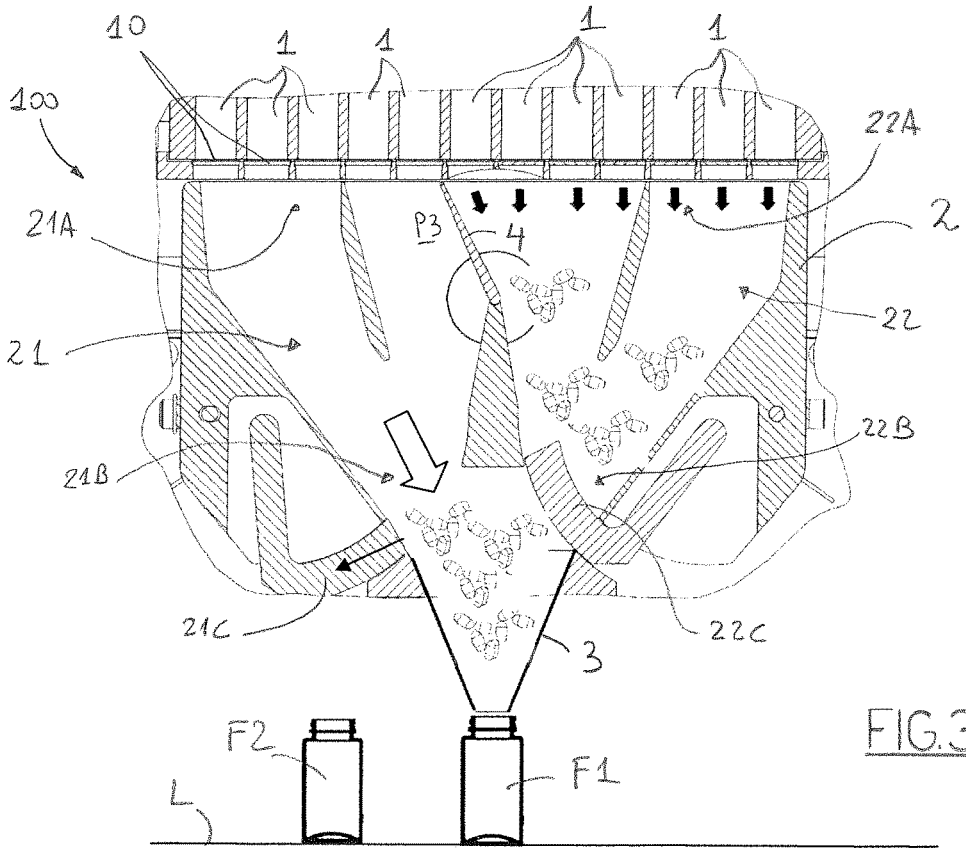

The separating wall (4) can also be positionable in a third position (P3) in which it is positioned between the 5th and 6th descent channel, as shown for example in FIG. 3C, so that the first entry section (21A) of the first accumulation chamber can receive pharmaceutical articles from 5 descent channels while the second entry section (22A) of the second accumulation chamber (22) can received pharmaceutical articles from 7 descent channels (1).

In the third position (P3) of the separating wall (4), the second accumulation chamber (22) can thus receive pharmaceutical articles falling from a greater number of descent channels (1) with respect to the first accumulation chamber (21).

The apparatus (100) further comprises sensor means (S) (some of which are schematically indicated in FIG. 2, as of known type), which are positioned and which are configured in such a way as to provide a datum relative to the number of pharmaceutical articles present internally of each descent channel (1) and falling into the first accumulation chamber (21) and into the second accumulation chamber (22), and blocking elements (10) for opening and closing the descent channels (1).

The blocking elements (10) are arranged and configured to be activatable to close the descent channels (1) which are in communication with the entry sections (21A, 22A) of the two accumulation chambers (21, 22) once that internally thereof the predetermined number of pharmaceutical articles to be inserted in a bottle has been reached, and to be activatable to open the descent channels (1) to enable the pharmaceutical articles to fall from the descent channels (1) into the two accumulation chambers (21, 22) in order to newly accumulate a predetermined number of pharmaceutical articles for filling successive bottles.

According to the preferred but not exclusive embodiment illustrated in the figures, the separating wall (4) is predisposed to be movable in rotation about a rotation axis.

The method of the present invention uses the above-described apparatus for carrying out the filling of the bottles advanced from the conveying line beneath the unloading conduit, with a predetermined number of pharmaceutical articles.

The method of the invention comprises carrying out steps of:

moving and positioning the separating wall (4) with respect to the descent channels (1) in an operating position so that the first entry section (21A) of the first accumulation chamber (21) and the second entry section (22A) of the second accumulation chamber (22) can respectively receive pharmaceutical articles from a different number of descent channels (1) with respect to one another so as to generate an imbalance in the accumulation of pharmaceutical articles between the first accumulation chamber (21) and the second accumulation chamber (22) with one of the two accumulation chambers (21, 22) accumulating more rapidly than the other the predetermined number of articles to be unloaded into a first bottle (F1) positioned by the conveying line (L) beneath the unloading conduit (3); activating the blocking elements (10) of the descent channels (1) communicating with the entry section (21A, 22A) of the accumulation chamber (21, 22) wherein, first, the predetermined number of pharmaceutical articles has been accumulated, for closing said descent channels (1) and then activating the closing element (21C, 22C) of the unloading mouth (21B, 22B) of said accumulation chamber (21, 22) in order to unload, into the unloading conduit (3), and therefore internally of the first bottle (F1) paused beneath the unloading conduit (3), the pharmaceutical articles accumulated therein;

while the other of the two accumulation chambers (21, 22) is completing the accumulation of the predetermined number of pharmaceutical articles, activating the conveying line (L) for positioning a second bottle (F2) beneath the unloading conduit (3), and then, as soon as the predetermined number of pharmaceutical articles has been accumulated in the other accumulation chamber (21, 22), activating the blocking elements (10) of the descent channels (1) communicating with the entry section (21A, 22A) of the other accumulation chamber (21, 22) to close the descent channels (1) and activating the closing element (21C, 22C) of the other accumulation chamber (21, 22) in order to open the respective unloading mouth (21B, 22B) to unload into the unloading conduit (3), and then internally of the second bottle (F2) paused beneath the unloading conduit (3), the pharmaceutical articles accumulated therein.

Therefore, in this way, with the method of the invention, by activating the separating wall it is possible to change the number of descent channels which are in communication with the two accumulation chambers in such a way as to obtain an imbalance in the filling thereof, in the sense of facilitating a fall of a greater number of pharmaceutical articles in one of the two accumulation chambers, and thus facilitate the reaching of the predetermined number of pharmaceutical articles to unload into a bottle more rapidly in one of the two chambers with respect to the other.

Consequently, once one of the two chambers has reached the predetermined number of pharmaceutical articles, and in the time period during which the other chamber also reaches the predetermined number, it will be possible to unload the pharmaceutical articles from the chamber in which the predetermined number of pharmaceutical articles internally of a bottle has already accumulated, and then, by activating the conveying line, it will be possible to position a further bottle beneath the unloading conduit.

In this way, as soon as the other chamber has reached and accumulated the predetermined number of pharmaceutical articles, it will be possible to unload said articles into the subsequent bottle waiting beneath the unloading conduit.

Therefore, with the method of the invention it is possible to use two accumulation chambers for unloading, with a single unloading conduit, time by time as the inside of one of the two accumulation chambers reaches the predetermined number of pharmaceutical articles, the pharmaceutical articles into a bottle which in the meantime is positioned beneath the unloading conduit.

It is clear that with the method of the invention the conveying line of the bottles can be activated with a frequency of positioning of each bottle beneath the unloading conduit at a frequency that is clearly superior to the prior-art, thus obtaining a significant increase in productivity.

This is because while one accumulation chamber unloads the pharmaceutical articles accumulated therein, the other accumulation chamber receives and accumulates pharmaceutical articles so as to be ready to unload the pharmaceutical articles as soon as a subsequent bottle is positioned beneath the unloading conduit.

Further preferred aspects of the method of the invention are set out in the following, with particular reference to the sequence of FIGS. from 3A to 3E.

Figure 3D:
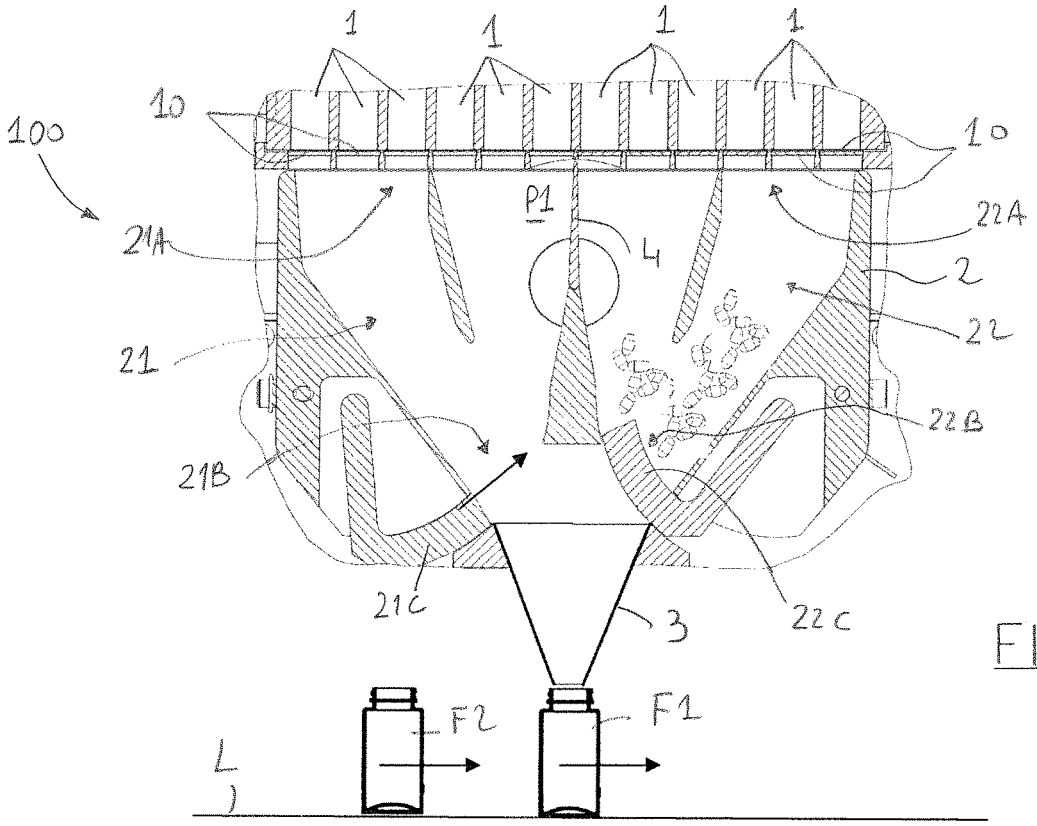
Figure 3E:
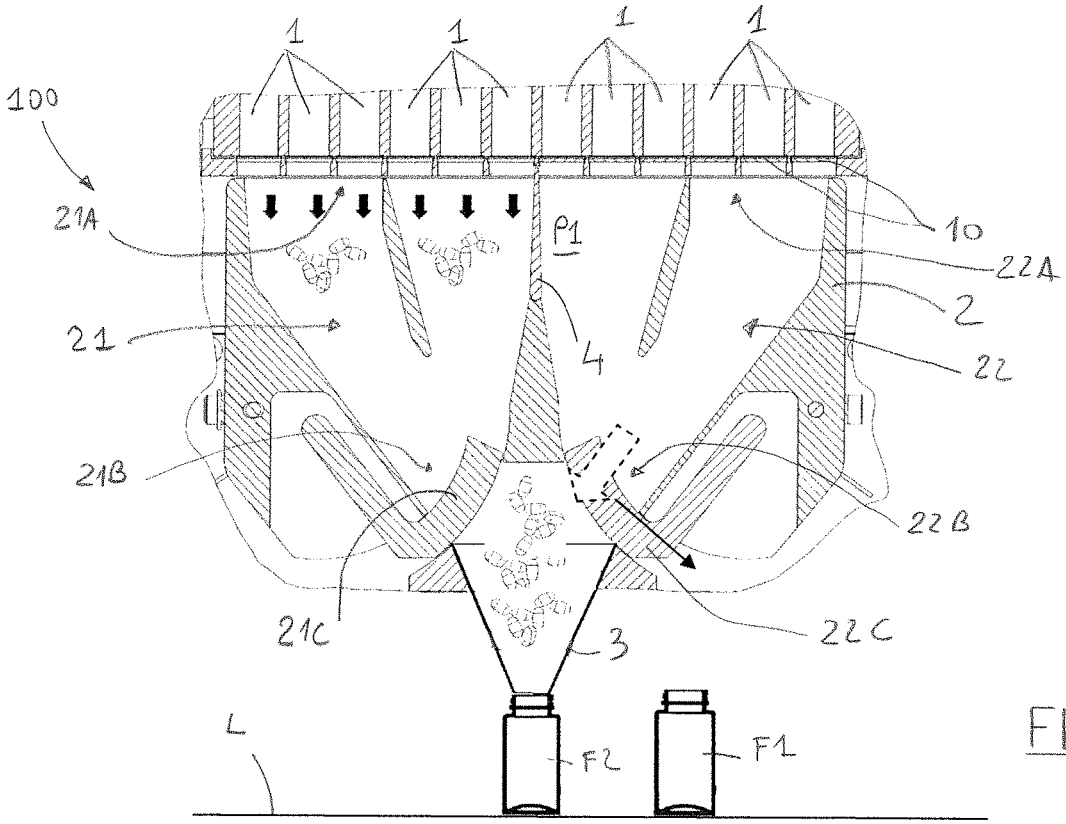

The method is such that, with the first closing element (21C) positioned in such a way as to close the first unloading mouth (21B) of the first accumulation chamber (21) and with the second closing element (22C) positioned in such a way as to close the second unloading mouth (22B) of the second accumulation chamber (22) (the situation of FIG. 2), the method comprises carrying out a cycle of steps which includes steps of:

positioning, by means of the conveying line (L), a first bottle (F1) paused beneath the unloading conduit (3) and positioning the separating wall (4) in an operating position (P2) with respect to the descent channels (1) so that the first entry section (21A) of the first accumulation chamber (21) can receive pharmaceutical articles from a greater number of descent channels (1) with respect to the second entry section (22A) of the second accumulation chamber (22) generating an imbalance in the accumulation of pharmaceutical articles between the first accumulation chamber (21) and the second accumulation chamber (22) with the first accumulation chamber (21) accumulating more rapidly than the second accumulation chamber (22) the predetermined number of articles to be unloaded into the first bottle (F1) paused beneath the unloading conduit (3) (see FIG. 3A);

as soon as the predetermined number of pharmaceutical articles to be inserted in the first bottle (F1) has been reached in the first accumulation chamber (21) (see FIG. 3B or FIG. 3C):

activating the blocking elements (10) to close the descent channels (1) communicating with the first entry section (21A) of the first accumulation chamber (21);

activating the first closing element (21C) to open the first unloading mouth (21B) in such a way as to unload the pharmaceutical articles accumulated in the first accumulation chamber (21) into the unloading conduit (3) and thus fill the first bottle (F1) positioned paused beneath the unloading conduit (3);

activating the first closing element (21C) to close the first unloading mouth (21B) (see FIG. 3D);

activating the conveying line (L) to position a second bottle (F2) paused beneath the unloading conduit (3) (see FIG. 3D or FIG. 3E);

activating the blocking elements (1) to open the descent channels (1) communicating with the entry section (21A) of the first accumulation chamber (21) (FIG. 3E);

as soon as the predetermined number of pharmaceutical articles to be inserted in the second bottle (F2) has been reached in the second accumulation chamber (22) (see FIG. 3E):

activating the blocking elements (10) to close the descent channels (1) communicating with the second entry section (22A) of the second accumulation chamber (22);

activating the second closing element (22C) to open the second unloading mouth (22B) in such a way as to unload the pharmaceutical articles accumulated in the second accumulation chamber (22) into the unloading conduit (3) and thus fill the second bottle (F2) positioned paused beneath the unloading conduit (3).

Preferably, in conjunction with or in consequence of the step of activating the first closing element (21C) to open the first unloading mouth (21C) in such a way as to unload the pharmaceutical articles accumulated in the first accumulation chamber (21) into the unloading conduit (3) and thus fill the first bottle (F1) positioned paused beneath the unloading conduit (3), the method comprises carrying out a step of moving and positioning the separating wall (4) with respect to the descent channels (1) in an operating position so that the second entry section (22A) of the second accumulation chamber (22) can receive pharmaceutical articles falling from at least a further descent channel (1) which previously was in communication with the first entry section (21A) and then activating the blocking element (10) of the at least a further descent channel (1) to open the further descent channel (1) and cause the articles contained therein to fall into the second accumulation chamber (22).

For example, and according to operating requirements which exist time by time, the separating wall (4) can moved and positioned in a position (P1) in which it is situated between the 6th and 7th descent channel (as illustrated in FIG. 3B), so as to increase by a descent channel the number of descent channels communicating with the second entry section of the second accumulation chamber which is still being filled, or can be positioned in a position (P3) in which it is situated between the 5th and 6th descent channel (as illustrated in FIG. 3C), so as to increase by two descent channels the number of descent channels communicating with the second entry section of the second accumulation chamber which is still being filled.

The cycle of steps described in the foregoing can be repeated cyclically. In this regard, in the cyclical carrying out of the cycle of steps described in the foregoing, the method comprises, before the start of the cycle of steps, and before the step of moving and positioning the separating wall (4) with respect to the descent channels (1) in an operating position so that the first entry section (21A) of the first accumulation chamber (21) and the second entry section (22A) of the second accumulation chamber (22) can respectively receive pharmaceutical articles from a different number of descent channels (1) with respect to one another, to include an initial positioning step of the blocking elements (10) of the descent channels (1) in such a way as to close the descent channels (1) (FIG. 2) and then, after the step of moving and positioning the separating wall (4) with respect to the descent channels (1) in an operating position so that the first entry section (21A) of the first accumulation chamber (21) and the second entry section (22A) of the second accumulation chamber (22) can respectively receive pharmaceutical articles from a different number of descent channels (1) with respect to one another, a step of activating the blocking elements (10) in order to open the descent channels (1) and enabling the pharmaceutical articles received and present internally of the descent channels (1) to fall and accumulate in the first accumulation chamber (21) and in the second accumulation chamber (22).

The invention claimed is:

1. A method for filling bottles with a predetermined number of pharmaceutical articles comprising:

predisposing a conveying line of bottles to be filled and an apparatus which is configured to receive, count and unload pharmaceutical articles and which is arranged above the conveying line of bottles to be filled, the apparatus comprising:

a plurality of descent channels of pharmaceutical articles which are configured to receive pharmaceutical articles internally thereof, and to cause the pharmaceutical articles to fall by gravity;

an accumulation container, arranged below the descent channels and superiorly having an entry mouth, for receiving pharmaceutical articles from the descent channels and, inferiorly, having an unloading conduit, for unloading pharmaceutical articles internally of a bottle positioned by the conveying line beneath the unloading conduit, wherein the accumulation container is conformed in such a way as to comprise:

a first accumulation chamber and a second accumulation chamber adjacent to one another;

a first unloading mouth, inferiorly of the first accumulation chamber, and communicating with the unloading conduit;

a second unloading mouth, inferiorly of the second accumulation chamber, and communicating with the unloading conduit;

a first closing element, activatable to open/close the first unloading mouth;

a second closing element, activatable to open/close the second unloading mouth;

a separating wall, arranged so as to mutually separate the first accumulation chamber and the second accumulation chamber in a zone at the entry mouth of the accumulation container and beneath the descent channels, and divide the entry mouth into a first entry section, for the first accumulation chamber, and a second entry section, for the second accumulation chamber, so that the first entry section can receive pharmaceutical articles from a first group of the descent channels and the first accumulation chamber can accumulate a predetermined number of pharmaceutical articles to be inserted in a bottle, and so that the second entry section can receive pharmaceutical articles from a second group of the descent channels and the second accumulation chamber can accumulate a predetermined number of pharmaceutical articles to be inserted in a bottle, wherein the separating wall is movable and positionable with respect to the descent channels in an operating position (P1) so that the first entry section and the second entry section can receive pharmaceutical articles from a same number of descent channels and in operating position (P2, P3) so that the first entry section and the second entry section can receive pharmaceutical articles also from a different number of descent channels with respect to one another;

the apparatus further comprising blocking elements, activatable to close the descent channels which are in communication with the entry sections of the two accumulation chambers once that internally thereof the predetermined number of pharmaceutical articles to be inserted in a bottle has been reached;

the method comprising carrying out steps of:

moving and positioning the separating wall with respect to the descent channels in an operating position so that the first entry section of the first accumulation chamber and the second entry section of the second accumulation chamber can respectively receive pharmaceutical articles from a different number of descent channels with respect to one another so as to generate an imbalance in the accumulation of pharmaceutical articles between the first accumulation chamber and the second accumulation chamber with one of the two accumulation chambers accumulating more rapidly than the other the predetermined number of articles to be unloaded into a first bottle positioned by the conveying line beneath the unloading conduit;

activating the blocking elements of the descent channels communicating with the entry section of the accumulation chamber wherein, first, the predetermined number of pharmaceutical articles has been accumulated, for closing said descent channels and then activating the closing element of said unloading mouth of said accumulation chamber in order to unload, into the unloading conduit, and therefore internally of the first bottle paused beneath the unloading conduit, the pharmaceutical articles accumulated therein;

while the other of the two accumulation chambers is completing the accumulation of the predetermined number of pharmaceutical articles, activating the conveying line for positioning a second bottle beneath the unloading conduit, and then, as soon as the predetermined number of pharmaceutical articles has been accumulated in the other accumulation chamber, activating the blocking elements of the descent channels communicating with the entry section of the other accumulation chamber to close the descent channels and activating the closing element of the other accumulation chamber in order to open the respective unloading mouth to unload into the unloading conduit, and then internally of the second bottle paused beneath the unloading conduit, the pharmaceutical articles accumulated therein.

2. The method of claim 1, wherein, with the first closing element positioned in such a way as to close the first unloading mouth of the first accumulation chamber and with the second closing element positioned in such a way as to close the second unloading mouth of the second accumulation chamber, the method comprises carrying out a cycle of steps which includes steps of:

positioning, by means of the conveying line, a first bottle paused beneath the unloading conduit and positioning the separating wall in an operating position (P2) with respect to the descent channels so that the first entry section of the first accumulation chamber can receive pharmaceutical articles from a greater number of descent channels with respect to the second entry section of the second accumulation chamber generating an imbalance in the accumulation of pharmaceutical articles between the first accumulation chamber and the second accumulation chamber with the first accumulation chamber accumulating more rapidly than the second accumulation chamber the predetermined number of articles to be unloaded into the first bottle paused beneath the unloading conduit;

as soon as the predetermined number of pharmaceutical articles to be inserted in the first bottle has been reached in the first accumulation chamber:

activating the blocking elements to close the descent channels communicating with the first entry section of the first accumulation chamber;

activating the first closing element to open the first unloading mouth in such a way as to unload the pharmaceutical articles accumulated in the first accumulation chamber into the unloading conduit and thus fill the first bottle positioned paused beneath the unloading conduit, activating the first closing element to close the first unloading mouth;

activating the conveying line to position a second bottle paused beneath the unloading conduit;

activating the blocking elements to open the descent channels communicating with the entry section of the first accumulation chamber;

as soon as the predetermined number of pharmaceutical articles to be inserted in the second bottle has been reached in the second accumulation chamber:

activating the blocking elements to close the descent channels communicating with the second entry section of the second accumulation chamber;

activating the second closing element to open the second unloading mouth in such a way as to unload the pharmaceutical articles accumulated in the second accumulation chamber into the unloading conduit and thus fill the second bottle positioned paused beneath the unloading conduit.

3. The method of claim 2, wherein, in conjunction with or in consequence of the step of activating the first closing element to open the first unloading mouth in such a way as to unload the pharmaceutical articles accumulated in the first accumulation chamber into the unloading conduit and thus fill the first bottle positioned paused beneath the unloading conduit, the method comprises carrying out a step of moving and positioning the separating wall with respect to the descent channels in an operating position so that the second entry section of the second accumulation chamber can receive pharmaceutical articles falling from at least a further descent channel which previously was in communication with the first entry section and then activating the blocking element of the at least a further descent channel to open the further descent channel and cause the articles contained therein to fall into the second accumulation chamber.

4. The method of claim 2, wherein the method comprises cyclically carrying out the cycle of steps and comprises, before the start of the cycle of steps, and before the step of moving and positioning the separating wall with respect to the descent channels in an operating position so that the first entry section of the first accumulation chamber and the second entry section of the second accumulation chamber can respectively receive pharmaceutical articles from a different number of descent channels with respect to one another, to include an initial positioning step of the blocking elements of the descent channels in such a way as to close the descent channels and then, after the step of moving and positioning the separating wall with respect to the descent channels in an operating position so that the first entry section of the first accumulation chamber and the second entry section of the second accumulation chamber can respectively receive pharmaceutical articles from a different number of descent channels with respect to one another, a step of activating the blocking elements in order to open the descent channels and enabling the pharmaceutical articles received and present internally of the descent channels to fall and accumulate in the first accumulation chamber and in the second accumulation chamber.

5. An apparatus for filling bottles with a predetermined number of pharmaceutical articles configured so as to carry out the method of the preceding claims and comprising:

a plurality of descent channels of pharmaceutical articles which are configured to receive the pharmaceutical articles internally thereof, and to cause to fall by gravity said pharmaceutical articles;

an accumulation container, arranged below the descent channels and having, superiorly, an entry mouth, for receiving the pharmaceutical articles from the descent channels and, inferiorly, having an unloading conduit, for unloading pharmaceutical articles internally of a bottle positioned in a conveying line beneath the unloading conduit, wherein the accumulation container is conformed in such a way as to comprise:

a first accumulation chamber and a second accumulation chamber adjacent to one another;

a first unloading mouth, inferiorly of the first accumulation chamber, and communicating with the unloading conduit;

a second unloading mouth, inferiorly of the second accumulation chamber, and communicating with the unloading conduit;

a first closing element, activatable to open/close the first unloading mouth;

a second closing element, activatable to open/close the second unloading mouth;

a separating wall, arranged so as to mutually separate the first accumulation chamber and the second accumulation chamber in a zone at the entry mouth of the accumulation container and beneath the descent channels, and divide the entry mouth into a first entry section, for the first accumulation chamber, and into a second entry section, for the second accumulation chamber, so that the first entry section can receive pharmaceutical articles from a first group of the descent channels and the first accumulation chamber can accumulate a predetermined number of pharmaceutical articles to be inserted in a first bottle, and so that the second entry section can receive pharmaceutical articles from a second group of the descent channels and the second accumulation chamber can accumulate a predetermined number of pharmaceutical articles to be inserted in a second bottle, wherein the separating wall is movable and positionable with respect to the descent channels inclusively: into a first position (P1), in which the separating wall is positioned so that the first entry section and the second entry section can receive pharmaceutical articles from a same number of descent channels, and at least into a second position (P2, P3), in which the separating wall is positioned so that the first entry section and the second entry section can receive articles from a different number of descent channels with respect to one another, the apparatus further comprising:

sensor means, which are positioned and which are configured in such a way as to provide a datum relative to the number of pharmaceutical articles present internally of each descent channel and falling into the first accumulation chamber and into the second accumulation chamber;

blocking elements for opening and closing the descent channels, the blocking elements being arranged and configured to be activatable to close the descent channels which are in communication with the entry sections of the two accumulation chambers once that internally thereof the predetermined number of pharmaceutical articles to be inserted in a bottle has been reached, and to be activatable to open the descent channels to enable the pharmaceutical articles to fall from the descent channels into the two accumulation chambers in order to newly accumulate a predetermined number of pharmaceutical articles for filling successive bottles.

6. The apparatus of claim 5, wherein the separating wall is movable with respect to the descent channels so as to be positionable in a second position (P2) in which the separating wall is positioned so that the first entry section, and therefore the first accumulation chamber, can receive articles from a greater number of descent channels with respect to the second entry section, and therefore with respect to the second accumulation chamber, and in which the separating wall is also movable so as to be positionable also in a third position (P3) in which the separating wall is positioned so that the second entry section, and therefore the second accumulation chamber, can receive articles from a greater number of descent channels with respect to the first entry section, and therefore with respect to the first accumulation chamber.

7. The apparatus of claim 6, wherein the separating wall is predisposed to be movable in rotation about a rotation axis.

8. An apparatus for filling bottles with a predetermined number of pharmaceutical articles, said apparatus comprising:

a plurality of descent channels configured to receive pharmaceutical articles and cause the pharmaceutical articles to fall by gravity;

an accumulation container arranged below the descent channels, the accumulation container having an entry mouth for receiving the pharmaceutical articles from the descent channels and an unloading conduit for unloading pharmaceutical articles internally of a bottle positioned in a conveying line beneath the unloading conduit, wherein the accumulation container is conformed in such a way as to comprise: a first accumulation chamber and a second accumulation chamber adjacent to one another; a first unloading mouth below the first accumulation chamber and communicating with the unloading conduit; a second unloading mouth below the second accumulation chamber and communicating with the unloading conduit; a first closing element selectively activatable to open/close the first unloading mouth; a second closing element selectively activatable to open/close the second unloading mouth; a separating wall arranged to mutually separate the first accumulation chamber and the second accumulation chamber in a zone at the entry mouth of the accumulation container and beneath the descent channels, and divide the entry mouth into a first entry section, for the first accumulation chamber, and into a second entry section, for the second accumulation chamber, so that the first entry section can receive pharmaceutical articles from a first group of the descent channels and the first accumulation chamber can accumulate a predetermined number of pharmaceutical articles to be inserted in a first bottle, and so that the second entry section can receive pharmaceutical articles from a second group of the descent channels and the second accumulation chamber can accumulate a predetermined number of pharmaceutical articles to be inserted in a second bottle, wherein the separating wall is movable and positionable with respect to the descent channels inclusively: into a first position (P1) in which the separating wall is positioned so that the first entry section and the second entry section can receive pharmaceutical articles from a same number of descent channels, and at least into a second position (P2, P3) in which the separating wall is positioned so that the first entry section and the second entry section can receive articles from a different number of descent channels with respect to one another, the apparatus further comprising:

a sensor positioned and configured to provide a datum relative to the number of pharmaceutical articles present internally of each descent channel and falling into the first accumulation chamber and into the second accumulation chamber;

blocking elements for opening and closing the descent channels, the blocking elements being arranged and configured to be activatable to close the descent channels which are in communication with the entry sections of the two accumulation chambers once that internally thereof the predetermined number of pharmaceutical articles to be inserted in a bottle has been reached, and to be activatable to open the descent channels to enable the pharmaceutical articles to fall from the descent channels into the two accumulation chambers in order to newly accumulate a predetermined number of pharmaceutical articles for filling successive bottles.

9. The apparatus of claim 8, wherein the separating wall is movable with respect to the descent channels between a second position (P2) and a third position (P3), in the second position (P2) the separating wall is positioned so that the first entry section can receive articles from a greater number of descent channels with respect to the second entry section, and in a third position (P3) the separating wall is positioned so that the second entry section can receive articles from a greater number of descent channels with respect to the first entry section.

10. The apparatus of claim 9, wherein the separating wall is movable in rotation about a rotation axis.

* * * * *